US007177580B2

(12) United States Patent
Nakafuji et al.

(10) Patent No.: US 7,177,580 B2
(45) Date of Patent: Feb. 13, 2007

(54) IMAGE FORMING METHOD AND APPARATUS FOR FIXING AN IMAGE

(75) Inventors: Atsushi Nakafuji, Tokyo (JP); Hiroyuki Kunii, Kanagawa-ken (JP); Yukimichi Someya, Saitama-ken (JP); Katsuhiro Echigo, Saitama-ken (JP); Takashi Fujita, Kanagawa-Ken (JP); Hisashi Kikuchi, Kanagawa-Ken (JP); Toshihiko Baba, Toyko (JP); Shigeo Kurotaka, Kanagawa-Ken (JP)

(73) Assignee: Ricoh Co., Ltd., Tokyo (JP)

( * ) Notice: Subject to any disclaimer, the term of this patent is extended or adjusted under 35 U.S.C. 154(b) by 81 days.

(21) Appl. No.: 10/998,089

(22) Filed: Nov. 29, 2004

(65) Prior Publication Data

US 2005/0117943 A1 Jun. 2, 2005

(30) Foreign Application Priority Data

Nov. 28, 2003 (JP) ..... 2003-400499

(51) Int. Cl.
*G03G 15/20* (2006.01)

(52) U.S. Cl. ..... 399/328; 399/330; 399/331; 399/333

(58) Field of Classification Search ..... 219/216; 399/320, 328, 329, 333, 330
See application file for complete search history.

(56) References Cited

U.S. PATENT DOCUMENTS

| | | | |
|---|---|---|---|
| 4,696,418 | A | 9/1987 | Kurotaka et al. |
| 4,985,733 | A | 1/1991 | Kurotori et al. |
| 4,987,457 | A | 1/1991 | Mochizuki et al. |
| 5,021,834 | A | 6/1991 | Tsuruoka et al. |
| 5,153,651 | A | 10/1992 | Kurotaka |
| 5,155,531 | A | 10/1992 | Kurotori et al. |
| 5,155,534 | A | 10/1992 | Kurotori et al. |
| 5,359,398 | A | 10/1994 | Echigo et al. |
| 5,384,225 | A | 1/1995 | Kurotori et al. |
| 5,456,782 | A | 10/1995 | Fujita et al. |
| 5,463,447 | A | 10/1995 | Kurotori et al. |
| 5,463,453 | A | 10/1995 | Kurotori et al. |
| 5,493,365 | A | 2/1996 | Matsui et al. |
| 5,504,590 | A | 4/1996 | Kawada et al. |
| 5,513,026 | A | 4/1996 | Suzuki et al. |
| 5,566,013 | A | 10/1996 | Susuki et al. |

(Continued)

FOREIGN PATENT DOCUMENTS

| | | |
|---|---|---|
| JP | 05-080666 | 4/1993 |

(Continued)

*Primary Examiner*—Hoang Ngo
(74) *Attorney, Agent, or Firm*—Oblon, Spivak, McClelland, Maier & Neustadt, P.C.

(57) ABSTRACT

An image forming apparatus, includes an image forming mechanism configured to form an image, and a fixing unit configured to fix a toner image formed on a recording medium. The fixing unit includes a fixing device having a first endless moving member configured to rotate, and a second endless moving member configured to rotate to form a nip area together with the first endless moving member to fix, at the nip area, a toner image disposed on the recording medium onto the recording medium with heat and pressure, the second endless moving member including a surface layer having a universal hardness HU and a maximum nip surface pressure P each within a predetermined range.

60 Claims, 6 Drawing Sheets

U.S. PATENT DOCUMENTS

| | | | |
|---|---|---|---|
| 5,592,275 | A | 1/1997 | Echigo et al. |
| 5,610,725 | A | 3/1997 | Kawada et al. |
| 5,642,188 | A | 6/1997 | Mochizuki et al. |
| 5,652,803 | A | 7/1997 | Tachikawa et al. |
| 5,659,628 | A | 8/1997 | Tachikawa et al. |
| 5,678,158 | A | 10/1997 | Kurotori et al. |
| 5,678,161 | A | 10/1997 | Kurotaka et al. |
| 5,708,949 | A | 1/1998 | Kasahara et al. |
| 5,751,854 | A | 5/1998 | Saitoh et al. |
| 5,783,288 | A | 7/1998 | Fujita et al. |
| 6,055,390 | A | 4/2000 | Kurotaka et al. |
| 6,078,766 | A | 6/2000 | Kurotaka et al. |
| 6,088,558 | A | 7/2000 | Yamada et al. |
| 6,108,906 | A | 8/2000 | Fujita et al. |
| 6,122,479 | A | 9/2000 | Fujita et al. |
| 6,150,066 | A | 11/2000 | Kurotori et al. |
| 6,198,888 | B1 | 3/2001 | Kurotaka et al. |
| 6,243,559 | B1 | 6/2001 | Kurotaka et al. |
| 6,262,787 | B1 | 7/2001 | Kamoi et al. |
| 6,272,248 | B1 | 8/2001 | Saitoh et al. |
| 6,347,212 | B1 | 2/2002 | Kosugi et al. |
| 6,366,751 | B1 | 4/2002 | Shakuto et al. |
| 6,501,935 | B2 | 12/2002 | Hirai et al. |
| 6,535,701 | B2 | 3/2003 | Baba |
| 6,542,705 | B2 | 4/2003 | Fujita et al. |
| 6,559,421 | B1 | 5/2003 | Yura et al. |
| 6,625,409 | B2 | 9/2003 | Shakuto et al. |
| 6,631,253 | B2 | 10/2003 | Nakafuji et al. |
| 6,636,718 | B2 | 10/2003 | Yura et al. |
| 6,646,227 | B2 | 11/2003 | Yura et al. |
| 6,654,579 | B2 | 11/2003 | Shakuto et al. |
| 6,721,532 | B2 | 4/2004 | Kosugi et al. |
| 6,795,676 | B2 | 9/2004 | Kikuchi et al. |
| 6,795,678 | B2 | 9/2004 | Yura et al. |
| 2002/0081128 | A1 | 6/2002 | Shakuto et al. |
| 2002/0090229 | A1 | 7/2002 | Shakuto et al. |
| 2003/0099479 | A1 | 5/2003 | Nakafuji et al. |
| 2003/0192869 | A1 | 10/2003 | Yura et al. |
| 2004/0022552 | A1 | 2/2004 | Yura et al. |
| 2004/0037595 | A1 | 2/2004 | Takashi et al. |
| 2004/0086293 | A1 | 5/2004 | Nakafuji et al. |
| 2004/0111888 | A1 | 6/2004 | Yura et al. |

FOREIGN PATENT DOCUMENTS

| | | |
|---|---|---|
| JP | 08-076620 | 3/1996 |
| JP | 10-198201 | 7/1998 |
| JP | 2002-072752 | 3/2002 |
| JP | 2002-148979 | 5/2002 |
| JP | 2003-076167 | 3/2003 |
| JP | 2003-098871 | 4/2003 |

IMAGE FORMING METHOD AND APPARATUS FOR FIXING AN IMAGE

CROSS REFERENCE TO RELATED APPLICATION

This application claims priority to Japanese patent application no. 2003-400499, filed on Nov. 28, 2003, the disclosure of which is incorporated by reference herein in its entirety.

BACKGROUND OF THE INVENTION

1. Field of the Invention

The present invention relates to a method and apparatus for image forming, and more particularly to a method and apparatus for image forming capable of effectively fixing a visible image on a recording medium.

2. Discussion of the Related Art

In a typical conventional image forming apparatus, a latent image formed on an image carrying member is developed with toner supplied from a developing device, and a visible toner image is formed on the image carrying member. The toner image formed on the image carrying member is then transferred to a recording medium by a transferring device and is fixed on the recording medium by a fixing device. Fixing members used in the fixing device include an endless fixing belt passing over at least two support members to rotate, and a press roller biasing the fixing belt with a predetermined pressure to form a nip, such as a fixing device that presses a recording medium by the heated fixing belt and the press roller to fix the toner image formed on the recording medium thereon with heat and pressure.

To improve the quality of an image formed by a color image forming apparatus, the fixing member can have a surface layer formed by an elastic layer. If the fixing member is formed of a rigid material and does not have a surface layer formed by the elastic layer, a surface of the fixing member contacting the recording medium (such as paper) does not fit microscopic concavities and convexities of a surface of the recording medium. As a result, the surface of the fixing member fails to closely contact the surface of the recording medium, resulting in deterioration in image quality (such as microscopic uneven glossiness of the image). This microscopic uneven glossiness may be referred to as "orange peel surface" problem. This problem is notably observed in an image formed by the color image forming apparatus, while the problem may not be particularly noticeable in an image formed by a monochrome image forming apparatus. In the color image forming apparatus, therefore, the surface of the fixing member should have elasticity to improve the quality of image.

Some conventional techniques attempt to solve the orange peel surface problem by focusing on hardness, such as JIS-A hardness, of the surface of the fixing member. One such fixing method is described in Japanese Laid Open patent publication no. 10-198201. In the fixing method in which low pressure is applied to a nip, however, the orange peel surface problem occurs. It is thus found that application of a certain level of pressure to the nip prevents the orange peel surface problem.

A fixing device performing image fixation by applying a certain level of pressure is disclosed, for example, in Japanese Laid-Open patent publication no. 2002-72752. FIG. 1 shows a schematic view of the fixing device as disclosed in the Japanese publication.

In FIG. 1, a fixing device 409 includes a fixing roller 401 and a press roller 402. The fixing roller 401 serves as a fixing member, and the press roller 402 serves as a press member. The fixing roller 401 includes a heater 405, a core metal 421, and a releasing layer 422. The heater 405 serves as a heating member. The core metal 421 is a base material having a rigid outer circumferential surface. The releasing layer 422 covers the outer circumferential surface of the core metal 421. Conversely, the press roller 402 includes a solid core metal 406, an elastic layer 423, and a polytetrafluoroethylene-perfluoroalkyl vinyl ether copolymer (PFA) tube 424. The elastic layer 423 is formed of a silicone rubber and covers the outer circumferential surface of the core metal 406. The elastic layer 423 is covered by the PFA tube 424, which serves as a releasing layer. In the fixing device thus configured, the fixing roller 401 heated by the heater 405 and the press roller 402 press a recording medium with a surface pressure of about 0.2 $N/mm^2$ to about 1.0 $N/mm^2$, for example. Surface pressure is obtained by dividing applied load by area of the nip applied with the load. In the fixing device, the heater 405 sufficiently heats the fixing roller 401, generating a large surface pressure of about 0.2 $N/mm^2$ or more, for example. Accordingly, the deterioration in image quality such as the uneven glossiness attributed to the microscopic concavities and convexities of the surface of the recording medium may be suppressed.

High pressure load needs to be applied to the fixing roller 401, however, to generate such a large surface pressure of about 0.2 $N/mm^2$ or more for preventing the orange peel surface problem attributed to the microscopic concavities and convexities of the surface of the recording medium. Further, the nip needs to have a large nipping area required for performing the image fixation. To obtain the required large nipping area, an elastic layer having a sufficient thickness or sufficient flexibility is required. If the elastic layer having sufficient flexibility is used, the elastic layer laterally extends, preventing the surface pressure from increasing, even if high pressure load is applied on the elastic layer. Therefore, the elastic layer having sufficient flexibility is not preferred. Accordingly, to form the nipping area having the large width required for performing the image fixation as well as prevent the orange peel surface problem, an elastic layer having a sufficient thickness and a rigid core metal having a diameter or thickness that prevents bending of the fixing roller under the high pressure load can be used. If the thickness of the elastic layer is increased, and the diameter or thickness of the core metal is increased, an amount of heat required for heating the fixing roller increases. As a result, time required for increasing the temperature of the fixing member up to a predetermined degree (referred to as start-up time) is increased. To reduce the start-up time, the temperature may be kept to a certain level by using residual heat. This attempt using the residual heat, however, is not preferable from a viewpoint of energy reduction.

Japanese Laid-Open patent publication no. 08-076620, discloses another fixing method referred to as an on-demand fixing. According to the method, a heat source is provided on the inside surface of the fixing belt forming the nip, and the nip is directly heated on demand. Accordingly, the start-up time is reduced. Further, the method requires no residual heat, thus saving energy.

However, due to the configuration in which the heat source is provided at the nip, it is difficult to apply sufficient surface pressure for preventing influence of the microscopic concavities and convexities of the recording medium surface. To prevent the deterioration in image quality such as the uneven glossiness attributed to the microscopic concavities and convexities of the recording medium surface while applying low pressure load to the fixing member, the fixing member should have a flexible surface layer. If a thick rubber layer is used to form the flexible surface layer, however, the amount of the heat required for heating the fixing member increases. As a result, the start-up time increases, making it difficult to perform the on-demand fixing method.

As described above, it is difficult to provide a fixing device capable of both reducing the start-up time and energy consumption and performing high-quality image fixation not affected by the microscopic concavities and convexities of the surface of the recording medium.

SUMMARY OF THE INVENTION

The present invention may remedy one or more of the above discussed, or other, disadvantages.

The present invention can provide an image forming apparatus, including an image forming mechanism configured to form an image, and a fixing unit configured to fix a toner image formed on a recording medium. The fixing unit includes a fixing device having a first endless moving member configured to rotate, and a second endless moving member configured to rotate to form a nip area together with the first endless moving member to fix, at the nip area, a toner image disposed on the recording medium onto the recording medium with heat and pressure, the second endless moving member including a surface layer having a universal hardness HU and a maximum nip surface pressure P each within a predetermined range.

The present invention can further provide an image forming apparatus, including image forming means for forming an image, and fixing means for fixing a toner image formed on a recording medium. The fixing means includes first endless moving means for rotating, and second endless moving means for rotating to form a nip area together with the first endless moving means for fixing, at the nip area, a toner image disposed on the recording medium onto the recording medium with heat and pressure, the second endless moving means including a surface layer having a universal hardness HU and a maximum nip surface pressure P each within a predetermined range.

The present invention can still further provide a method for image forming for effectively fixing an image, including providing a first endless moving member configured to rotate, providing a second endless moving member configured to rotate to form a nip area together with the first endless moving member, rotating the first and second endless moving members, forming a toner image on a recording medium, conveying the recording medium to the nip area, and fixing, at the nip area, the toner image disposed on the recording medium onto the recording medium with heat and pressure, wherein the second endless moving member includes a surface layer having a universal hardness HU and a maximum nip surface pressure P each within a predetermined range.

The present invention can still further provide the fixing device.

The present invention can still further provide a method for effectively fixing an image, including providing a first endless moving member configured to rotate, providing a second endless moving member configured to rotate to form a nip area together with the first endless moving member, rotating the first and second endless moving members, forming a toner image on a recording medium, conveying the recording medium to the nip area, and fixing, at the nip area, the toner image disposed on the recording medium onto the recording medium with heat and pressure, wherein the second endless moving member includes a surface layer having a universal hardness HU and a maximum nip surface pressure P each within a predetermined range.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
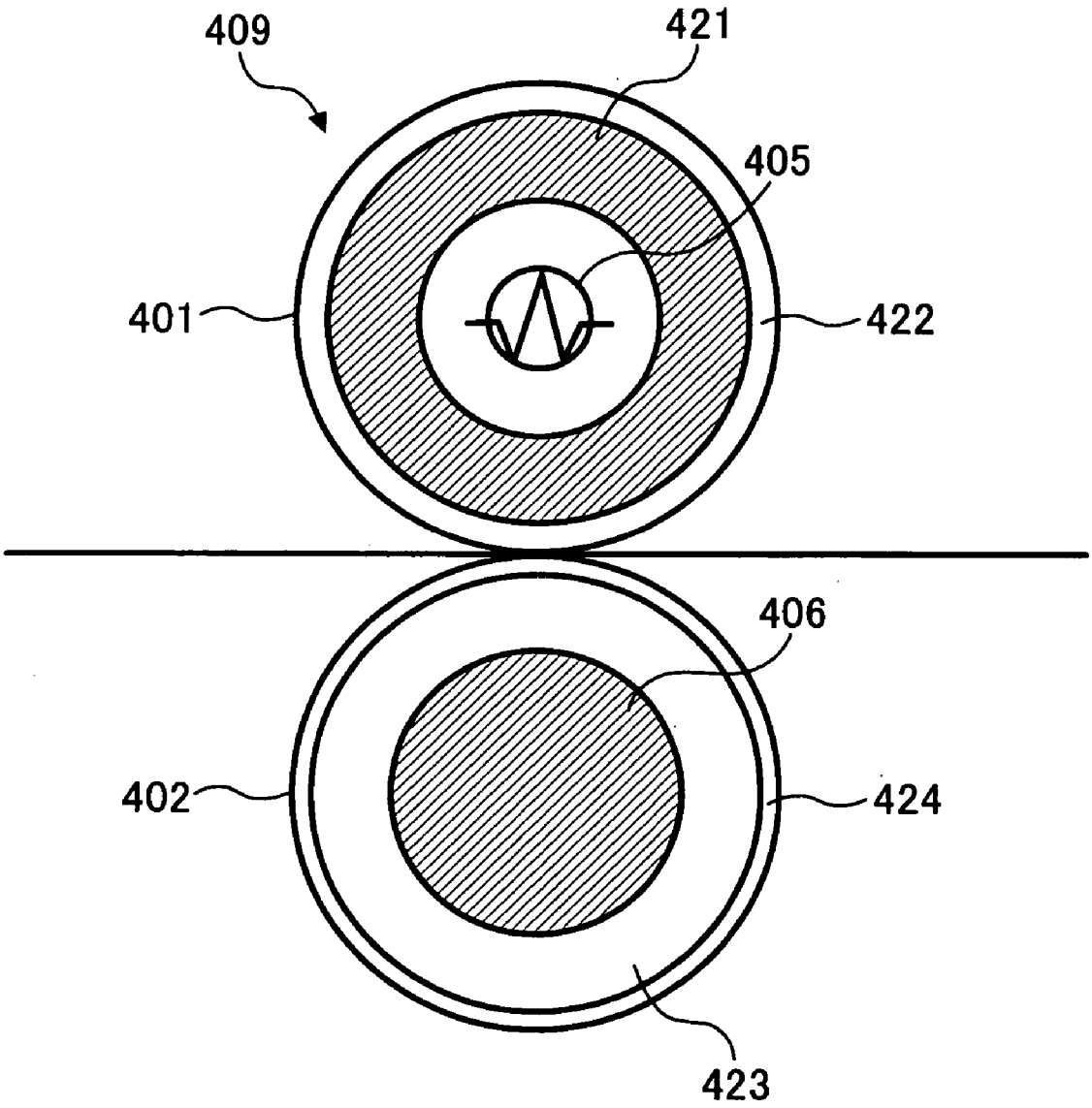
FIG. 1 PRIOR ART
FIG. 1 is a schematic view of a conventional fixing device.

In describing preferred embodiments illustrated in the drawings, specific terminology is employed for the purpose of clarity. However, the disclosure of this patent specification is not intended to be limited to the specific terminology used, and it is to be understood that substations for each specific element can include any technical equivalents that operate in a similar manner. Referring now to the drawings, wherein like reference numerals designate identical or corresponding parts throughout the several views, FIG. 2 illustrates a configuration of a full-color printer using an electrophotographic method, as an example of the image forming apparatus according to the embodiment of the present invention.

Figure 2:
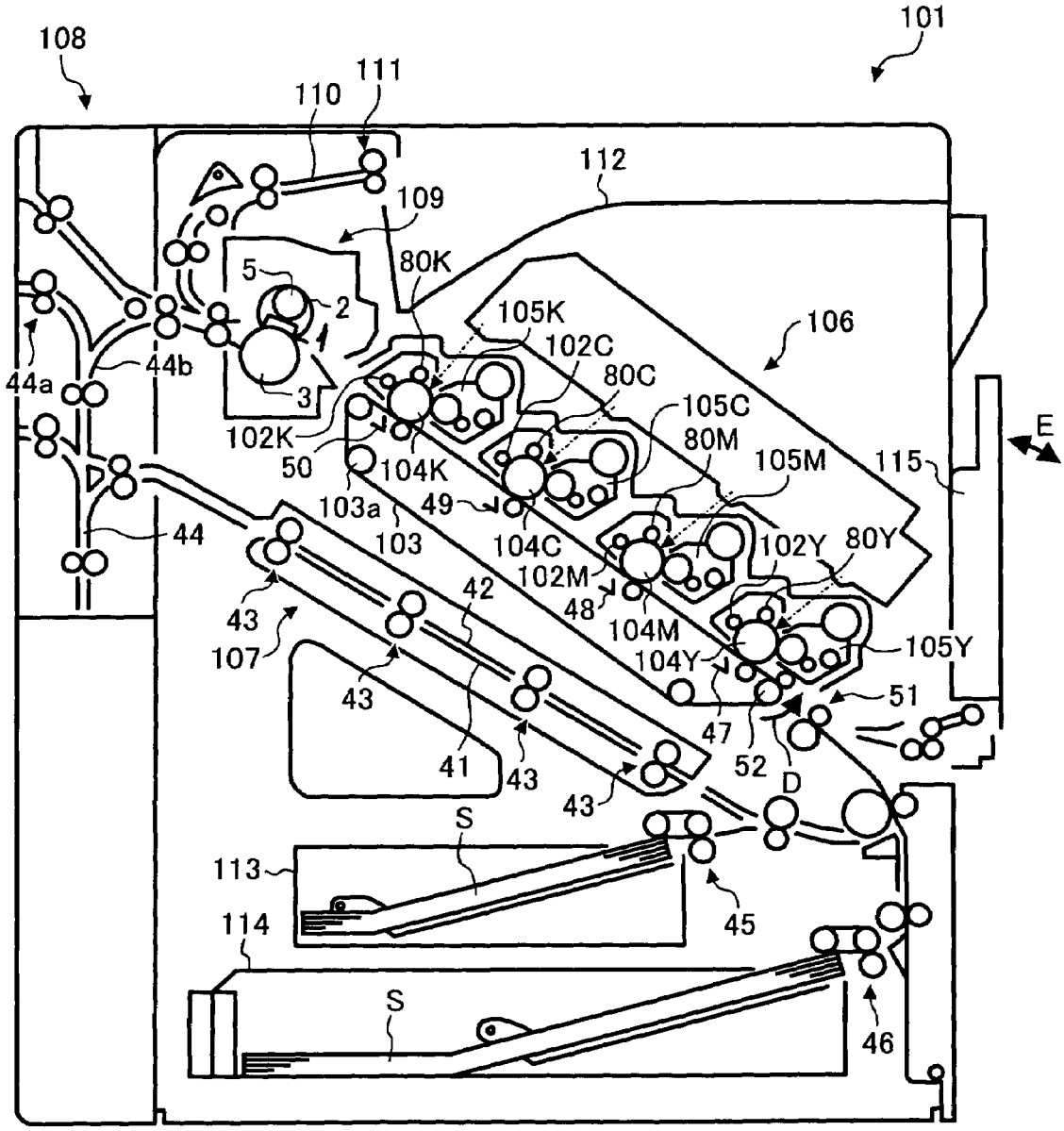
FIG. 2 is a schematic view of a printer according to an embodiment of the present invention.

As shown in FIG. 2, the full color printer 101 includes: photoconductor units 102Y, 102M, 102C, and 102K; a transfer belt 103; photoconductors 104Y, 104M, 104C, and 104K; developing devices 105Y, 105M, 105C, and 105K; a writing device 106; a duplex unit 107; a reversing unit 108; a fixing device 109; a reversal conveyance path 110; a discharge roller 111; an external tray 112; sheet-feeding cassettes 113 and 114; and a manual sheet-feeding tray 115.

The photoconductor units 102Y, 102M, 102C, and 102K are configured to be attached to or detached from the full-color printer 101. The photoconductor units 102Y, 102M, 1020, and 102K include the corresponding photoconductors 104Y, 104M, 104C, and 104K and the corresponding chargers 80Y, 80M, 80C, and 80K, respectively. The photoconductor units 102Y, 102M, 102C, and 102K are positioned above the transfer belt 103 such that the surfaces of the photoconductors 104Y, 104M, 104C, and 104K contact the transfer belt 103. Further, the photoconductor units 102Y, 102M, 102C, and 102K are arranged such that the photoconductor unit 102Y is positioned at or adjacent a feeding side of a recording medium and the photoconductor unit 102K is positioned at or adjacent a side of the fixing device 109. Thus, the photoconductors 104Y, 104M, 104C, and 104K are arranged in a right-to-left direction in FIG. 2. Each of the photoconductor units 102Y, 102M, 102C, and 102K is provided for forming a toner image of the corresponding color yellow (hereafter referred to by Y), magenta (hereafter referred to by M), cyan (hereafter referred to by C), or black (hereafter referred to by K), on the corresponding photoconductor 104Y, 104M, 104C, or 104K.

The chargers 80Y, 80M, 80C, and 80K are included in the corresponding photoconductor units 102Y, 102M, 102C, and 102K, respectively, and serve as charging units for charging the corresponding photoconductors. The chargers 80Y, 80M, 80C, and 80K are similar to one another, and are disposed at different positions in the full-color printer 101. Similarly, the photoconductor units 102Y, 102M, 102C, and 102K are similar to one another, and are disposed at different positions in the full-color printer 101. Each of the chargers 80Y, 80M, 80C, and 80K includes a commonly available charge roller contacting to uniformly charge the surface of the corresponding photoconductor.

The transfer belt 103 is provided in an approximate center of the full-color printer 101. The transfer belt 103 passes over an adhesion roller 52 and a plurality of rollers 103*a*, one of which receives rotation driving force for driving to rotate the transfer belt 103 in a direction indicated by arrow D shown in FIG. 2. Further, the transfer belt 103 is positioned to be pressed to contact the surfaces of the photoconductors 104Y, 104M, 104C, and 104K. The transfer belt 103 serves as a transferring member as well as a recording medium carrying member. The transfer belt 103 used in this embodiment employs a contact transfer method. The transfer belt 103 further includes, in a space encircled by the transfer belt 103, transfer brushes 47, 48, 49, and 50 facing the photoconductors 104Y, 104M, 104C, and 104K, respectively. The transfer brushes 47, 48, 49, and 50 serve as transferring members. Further, at a right side of the transfer belt 103 in FIG. 2, which is the feeding side of the recording medium, a pair of registration rollers 51 is provided.

The photoconductors 104Y, 104M, 104C, and 104K are drum-shaped and serve as image carrying members. The photoconductors 104Y, 104M, 104C, and 104K may be replaced by a belt, however. The transfer belt 103 and the respective photoconductors 104Y, 104M, 104C, and 104K form transfer sections (not shown).

The developing devices 105Y, 105M, 105C, and 105K are provided at an opposite side of the corresponding photoconductors 104Y, 104M, 104C, and 104K, respectively, and serve as developing units. The developing devices 105Y, 105M, 105C, and 105K each contain two-component developer of a different color. That is, each two-component developer includes carrier granules having toner particles of Y, M, C, or K, for example. Each of the developing devices 105Y, 105M, 105C, and 105K uses the developer to develop an electrostatic latent image formed on the corresponding photoconductor 104Y, 104M, 104C, or 104K.

The writing device 106 is provided generally above the photoconductor units 102Y, 102M, 102C, and 102K and serves as an exposure unit.

The duplex unit 107 is provided generally below the transfer belt 103. The duplex unit 107 includes a pair of conveyance guides 41 and 42, and pairs of conveyance rollers 43. The duplex unit 107 is used when a duplex image formation mode is selected to form an image on each surface of a recording medium S.

The reversing unit 108 is provided at a left side of the full-color printer 101 in FIG. 2. The reversing unit 108 includes a reversal conveyance path 44, which is provided with a plurality of conveyance rollers 44*a* and a plurality of conveyance guide plates 44*b*. The reversing unit 108 is used when the duplex image formation mode is selected. The reversing unit 108 reverses a recording medium S after an image has been formed on one surface of the recording medium S, and sends the recording medium S to the duplex unit 107. The reversing unit 108 discharges the image-formed recording medium S to the outside of the printer, with the surfaces of the recording medium S reversed or not.

At a downstream side of the fixing device 109 in the conveyance direction of the recording medium S, a conveyance path extending from the fixing device 109 branches off, with one branch formed into the reversal conveyance path 110. The reversal conveyance path 110 is provided with a pair of the discharge rollers 111, which guides the recording medium S to the external tray 112 provided on the top of the printer.

The sheet-feeding cassettes 113 and 114 are provided generally below the duplex unit 107. The sheet-feeding cassettes 113 and 114 store different sizes of sheets of recording medium S, respectively. The sheet-feeding cassettes 113 and 114 are provided with recording medium separators 45 and 46, respectively, each of which separates a top sheet of the recording medium S from other sheets stacked in the sheet-feeding cassette and feeds the separated sheet to the transfer belt 103.

The manual sheet-feeding tray 115 is provided at a right side of the full-color printer 101 in FIG. 2 to be opened or closed in a direction indicated by arrows E.

Referring to FIG. 2, operation of image formation performed in the full-color printer 101 is described.

In this full-color printer 101, upon receipt of instruction to form an image from an operation section (not shown), the photoconductors 104Y, 104M, 104C, and 104K are driven to rotate in a clockwise direction by a drive source (not shown). Then, a charge bias is supplied from a power source (not shown) and applied to each of the charge rollers included in the chargers 80Y, 80M, 80C, and 80K. As a result, the charge rollers uniformly charge the corresponding photoconductors 104Y, 104M, 104C, and 104K. Thereafter, a laser beam modulated in accordance with image data of each of the colors Y, M, C, and K is applied to the corresponding photoconductor 104Y, 104M, 104C, or 104K in the writing device 106, so that an electrostatic latent image is formed on the surface of the individual photoconductor. The electrostatic latent image thus formed on the surface of the individual photoconductor 104Y, 104M, 104C, or 104K is then developed with developer carriers included in the corresponding developing device 105Y, 105M, 105C, or 105K, respectively. As a result, toner images of the colors Y, M, C, and K are formed on the respective photoconductors 104Y, 104M, 104C, and 104K.

In one of the sheet-feeding cassettes 113 and 114 selected by a user, a top sheet of the recording media S is separated from other sheets stacked in the cassette, and is conveyed to a pair of the registration rollers 51. In the present embodiment, the manual sheet-feeding tray 115 is provided at the right side of the full-color printer 101 in FIG. 2. Alternatively, the recording medium S may be also sent from the manual sheet-feeding tray 115 to the pair of the registration rollers 51. The pair of the registration rollers 51 sends each recording medium S onto the transfer belt 103 at a time when a leading edge of the recording medium S aligns with the toner images formed on the photoconductors 104Y, 104M, 104C, and 104K. The recording medium S then electrostatically adheres to the transfer belt 103 charged by a pair of the adhesion rollers 52, so that transfer belt 103 conveys the recording medium S to the respective transfer sections.

When the recording medium S passes through each of the transfer sections, the toner images formed on the respective photoconductors 104Y, 104M, 104C, and 104K with the corresponding color toners of Y, M, C, and K are sequentially superimposed and transferred to the recording medium S. As a result, a full-color toner image having the four colors superimposed is formed. The recording medium S having the full-color toner image formed thereon is then sent to the fixing device 109, where the full-color toner image is fixed on the recording medium S as the toner forming the toner image is fused and then hardened. Thereafter, the recording medium S may be reversed and discharged to the external tray 112 through a conveyance path according to a selected mode, or may be directly discharged from the fixing device 109 through the reversing unit 108.

When the duplex image forming mode is selected in the full-color color printer, a toner image is formed first on one surface of the recording medium S and fixed thereon at the fixing device 109. Then, the recording medium S is sent to the reversal conveyance path 44 in the reversing unit 108. Thereafter, a switch-back operation is performed to send the recording medium S back to the duplex unit 107. The duplex unit 107 then receives the reversed recording medium S, and feeds the recording medium S again to the transfer sections to form an image on the other surface of the recording medium S in the same manner as used in forming the image on the front surface of the recording medium S. The recording medium S, on both sides of which the images have been formed, is discharged.

The operation of image formation described above is performed when the operation section (not shown) selects a full-color mode using the four colors. If the operation section selects a full-color mode using three colors, the black (K) toner image is not formed. Namely, a full-color image is formed on the recording medium S by superposing the yellow (Y) toner image, the magenta (M) toner image, and the cyan (C) toner image. Conversely, if the operation section selects a monochrome image mode, only the black (K) toner image is formed, so that a monochrome image is formed on the recording medium S.

Figure 3:
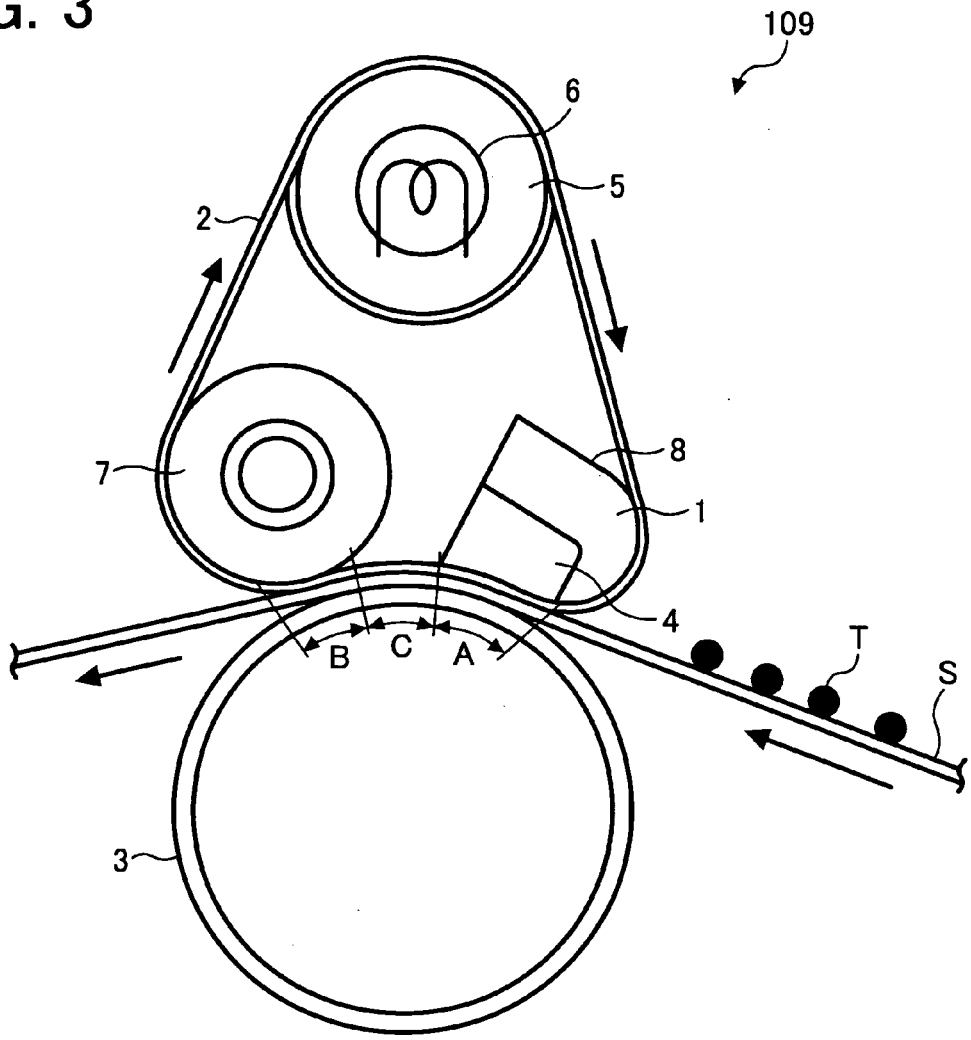
FIG. 3 is a schematic view of the fixing device included in the printer of FIG. 2.

Referring to FIG. 3, the fixing device 109 used in the full-color printer 101 of FIG. 2 is then described. The fixing device 109 includes a press member 1, a fixing belt 2, a press roller 3, a nip entrance fixing pad 4, a heating roller 5, a heat source 6, a backup roller 7, and a sliding member 8.

In the fixing device 109, the fixing belt 2 passes over three support members, i.e., the heating roller 5, the backup roller 7, and the press member 1. The heating roller 5 includes the heat source 6 such as a halogen heater to heat the fixing belt 2 from inside thereof. The press roller 3 is positioned to face the fixing belt 2 so that the press roller 3 is pressed against the backup roller 7 and the press member 1, which contacts an outer surface of the press roller 3 via the fixing belt 2. The press member 1, which is a stationary member that does not rotate, slidingly contacts the inside surface of the fixing belt 2. A surface layer of the press member 1 includes the sliding member 8 having a relatively low friction coefficient for reducing sliding friction resistance of the surface layer. The press member 1 further includes the nip entrance fixing pad 4, which is an elastic layer having adiathermancy such as sponge. The press member 1 thus configured forms a nip portion included in a fixing nip area, together with the press roller 3, at a region where the press roller 3 presses to contact the press member 1 via the fixing belt 2. Further, a surface layer of the backup roller 7 includes an elastic layer having adiathermancy such as sponge, and forms another nip portion included in the fixing nip area, together with the press roller 3, at a region where the press roller 3 presses to contact the backup roller 7 via the fixing belt 2. A surface layer of the press roller 3 includes a releasing layer formed of such material as a resin sold under the trademark TEFLON. The press roller 3 includes an elastic layer formed of such material as a silicone rubber, which is higher in hardness than the elastic layers used in the press member 1 and the backup roller 7.

Figure 4:
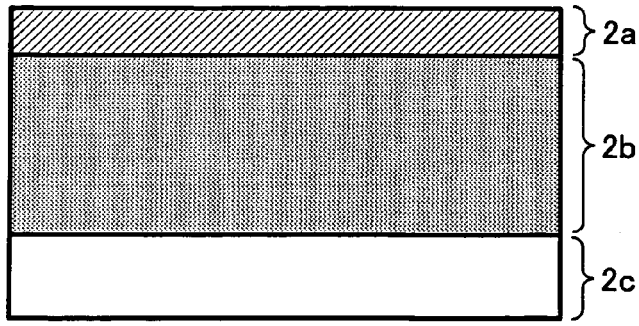
FIG. 4 is an enlarged cross-sectional view of the fixing belt included in the fixing device of FIG. 3.

Referring to FIG. 4, materials forming the fixing belt 2 are described. The fixing belt 2 is formed by laminating a base material layer 2*c*, an elastic layer 2*b*, and a releasing layer 2*a* such that the base material layer 2*c* forms the inside surface of the fixing belt 2. The base material layer 2*c* of the fixing belt 2 takes a shape of an endless belt including such material as a heat-resistant resin or a metal. A heat-resistant resin base material layer includes polyimide, polyamidoimide, polyetherketone (PEEK), or the like. A metal base material layer includes nickel, aluminum, iron, or the like. Thickness of the base material layer 2*c* is preferably in a range of from about 50 μm to about 125 μm, for example. If the base material layer 2*c* has a thickness below the above range, the base material layer 2*c* fails to have sufficient strength, reducing durability and rigidity of the base material layer 2*c*. As a result, conveyance performance of the fixing belt 2 is deteriorated. If the thickness of the base material layer 2*c* is increased, on the other hand, the amount of heat required for heating the fixing belt 2 increases. As a result, prompt start-up of the fixing device 109 including the fixing belt 2 is impeded. An outside surface layer of the fixing belt 2 is pressed to contact the sheet-shaped recording medium S such as a transfer sheet carrying toner T thereon. Therefore, the outside surface layer of the fixing belt 2 should have good releasability from toner. Further, the outside surface layer of the fixing belt 2 preferably has good heat resistance and durability. To obtain these characteristics, the surface layer of the fixing belt 2 is formed by a heat-resistant layer having good releasability from toner, which include polytetrafluoroethylene resin (PTFE), polytetrafluoroethylene-perfluoroalkyl vinyl ether copolymer (PFA), polytetrafluoroethylene-hexafluopropylene copolymer resin (FEP), and the like. The fixing belt 2 includes, between the base material layer 2*c* and the releasing layer 2*a*, the elastic layer 2*c*, which is heat-resistant and is formed by such material as a silicone rubber.

Next, referring again to FIG. 3, operation of image fixation performed in the fixing device 109 according to the present embodiment is described. The backup roller 7 and the press roller 3 are driven to rotate by a driving mechanism (not shown). The fixing device 109 is provided with a temperature sensor (not shown) contacting the fixing belt 2 to sense and control a fixing temperature of the surface of the fixing belt 2. The sheet shaped recording medium S such as the transfer sheet carrying the toner T thereon passes through a plurality of nip portions, which form the nip area between the fixing belt 2 and the press roller 3. Then, heat and pressure are applied to the recording medium S at each of the plurality of the nip portions, so that the toner T disposed on the recording medium S is fixed to the recording medium S.

In FIG. 3, a portion A, which is closer to an entrance of the nip area than to a center of the nip area, refers to a first nip portion formed by the press roller 3 and the press member 1 when the press roller 3 contacts the press member 1 via the fixing belt 2. A portion B, which is closer to an exit of the nip area than to the center of the nip area, refers to a second nip portion formed by the press roller 3 and the backup roller 7 when the press roller 3 contacts the backup roller 7 via the fixing belt 2. A portion C, which is at an approximate center of the nip area and is disposed between the nip portions A and B, refers to a belt nip portion formed by the press roller 3 and the fixing belt 2. Restated, the first nip portion A is located at an upstream side and the second nip portion B is located at a downstream side in the conveyance direction of the recording medium S. The surface pressure is set to be higher at the second nip portion B than at the first nip portion A.

Figure 5A:
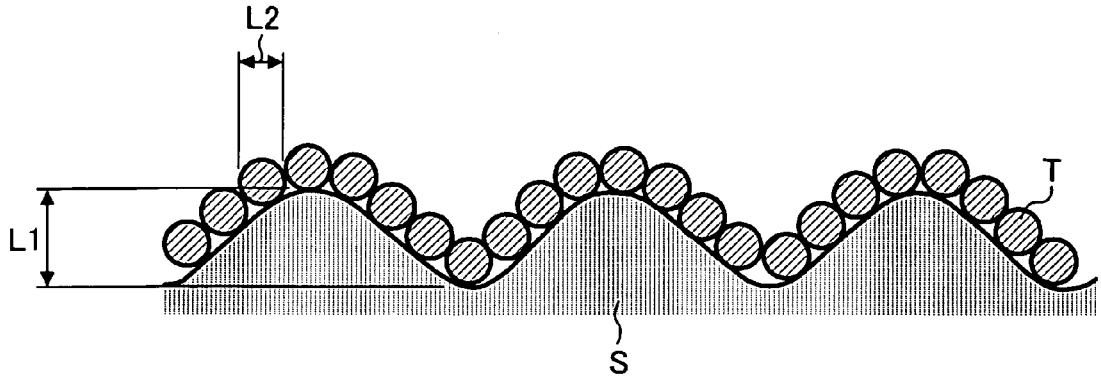
FIG. 5A is an enlarged cross-sectional view of a microscopic region of a recording medium carrying toner.
Figure 5B:
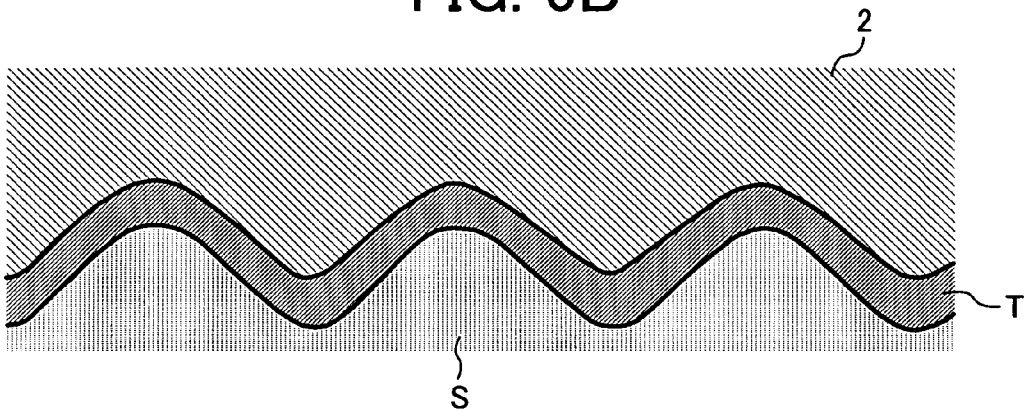
FIGS. 5B and 5C are enlarged cross-sectional views of a microscopic region where the recording medium carrying toner contacts a recording medium at a nip area.
Figure 5C:
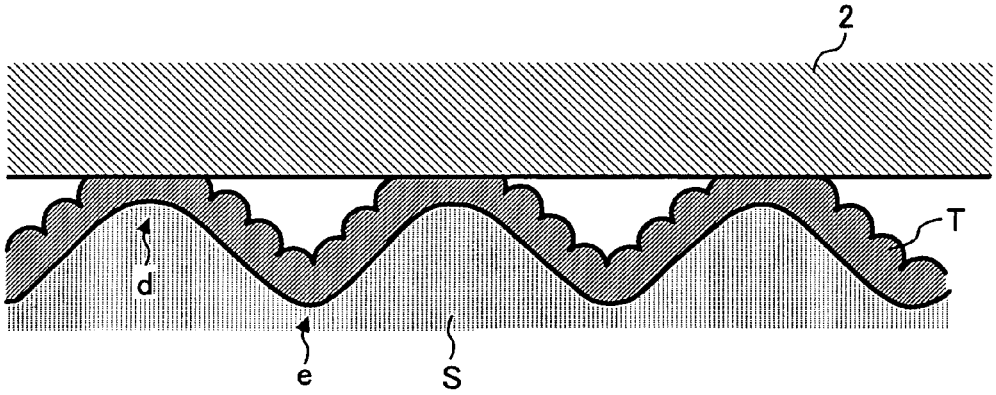

FIGS. 5A to 5C shows the occurrence of the deterioration in image quality such as the uneven glossiness attributed to the microscopic concavities and convexities of the surface of the recording medium S, which may occur in the fixing device 109 described above. FIG. 5A is a diagram illustrating an enlarged cross-sectional view of a microscopic region of the recording medium S carrying the toner T. The toner T is not yet fixed on the recording medium S. A diameter of a toner particle L2 is a few μm, for example. Meanwhile, a surface of commonly used paper has concavities and convexities due to protrusion of fibers forming the paper. A vertical difference L1 between the bottom of a concave portion and the top of a convex portion of the commonly used paper ranges from about 10 μm to about 20 μm, for example. As illustrated in FIG. 5A, the toner T is transferred and adheres to the surface of the paper. The toner T is then fixed on the surface of the paper by the fixing device 109. To prevent the uneven glossiness, as illustrated in FIG. 5B, the fixing belt 2 should have a surface capable of changing form thereof to fit the concavities and convexities of the paper surface and thus allowing the toner T to fit the concavities and convexities to be evenly fixed on the surface of the paper, so that a glossy image having even glossiness may be obtained. To produce a fixing member, which is the fixing belt 2 in this embodiment, having these characteristics, a surface layer of the fixing member should have sufficient flexibility at a microscopic level so as to fit concavities and convexities of a surface of a recording medium. Even when the flexibility of a surface layer of the fixing member is increased, however, the surface layer may not fit the concavities and convexities of the surface of the recording medium, if applied pressure is inadequate. It is thus understood that, as well as the flexibility of the surface layer of the fixing member, a predetermined level of pressure to be applied on the fixing member can prevent the deterioration in image quality such as the uneven glossiness attributed to the microscopic concavities and convexities of the surface of the recording medium.

Conversely, if the surface layer of the fixing member, i.e., the fixing belt 2 in this embodiment, is too rigid having no elastic layer, the surface of the fixing member may not fit the microscopic concavities and convexities of the surface of the recording medium S, as illustrated in FIG. 5C, even if the pressure applied to at a nip portion is increased. As a result, the pressure is applied to a convex portion d but not to a concave portion e shown in FIG. 5C. Accordingly, the toner T is fixed on the convex portion d by the pressure and heat applied thereto, so that the convex portion d contributes to production of a smooth-surfaced, glossy image. Meanwhile, the toner T is fixed on the concave portion e by the heat but not by pressure. Namely, the toner T is fused by the heat and then hardened without receiving any pressure, so that the smooth-surfaced image is not obtained. Accordingly, a difference in glossiness is observed between the concave portion and the convex portion, and the obtained image has the uneven glossiness.

Figure 6:
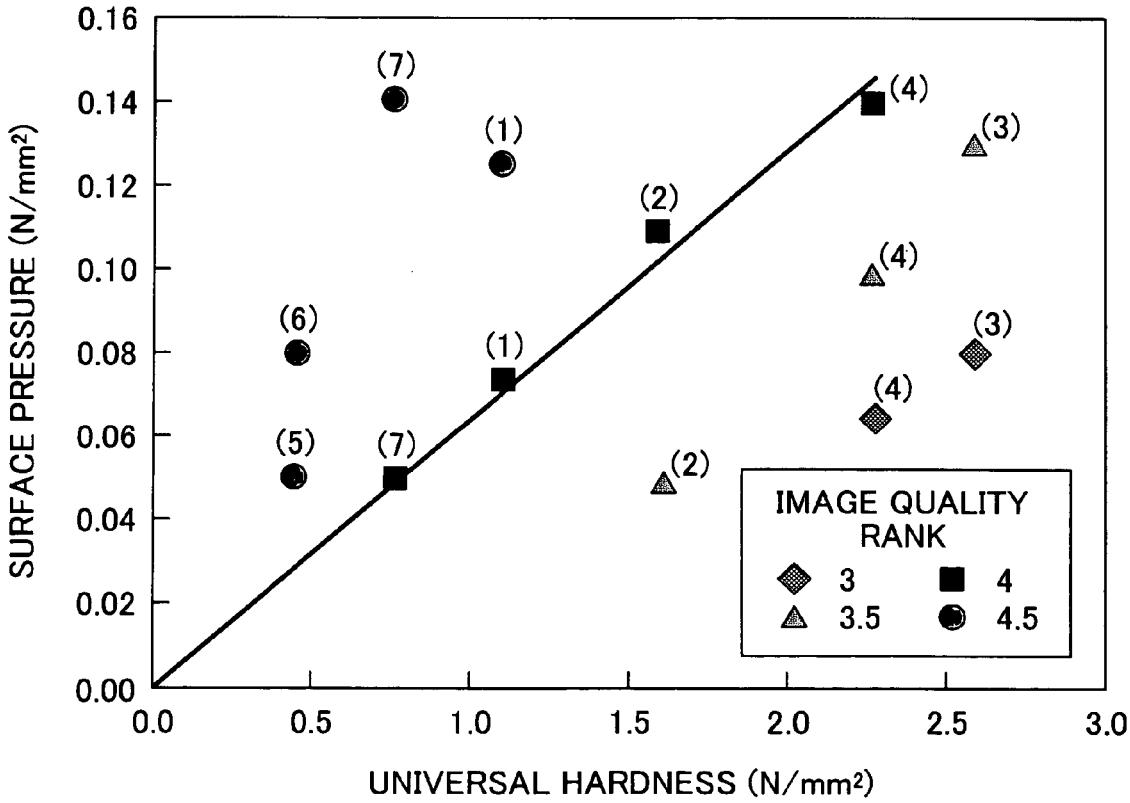
FIG. 6 is a graph indicating relationships between image quality and universal hardness of a surface layer of a fixing belt and between image quality and maximum surface pressure applied at a nip area

The present inventors examined the deterioration in image quality such as the uneven glossiness attributed to the microscopic concavities and convexities of the surface of the recording medium S observed in an image formed by a fixing device 109 using the fixing belt 2 as illustrated in FIGS. 3 and 4. It was determined through examination that the pressure applied at the second nip portion B, which is an exit portion of the nip area, and the hardness of the surface layer of the fixing belt 2 are factors affecting the occurrence of the orange peel surface problem, which is an example of the deterioration in image quality. FIG. 6 is a graph illustrating relationships between the deterioration in image quality and the affecting factors, including the pressure applied at the second nip portion B and the hardness of the surface layer of the fixing belt.

As described above, the uneven glossiness is caused in the fixing device 109 when the toner forming the surface of a painted-out image poorly fits the microscopic concavities and convexities of a surface of paper. The microscopic concavities and convexities may be observed by examining the surface of the paper through a microscope. In a case of normally used paper, a difference in height, width, or the like between a concave portion and a convex portion ranges from about 10 μm to about 20 μm, for example. Thickness of toner images layered on the paper also amounts to about 10 μm to about 20 μm, for example, in a case of a color toner image. In consideration of these thickness values, the present examination used a universal hardness measurement method, which is designed to measure hardness of an object at a microscopic level, for measuring the hardness of the surface layer of the fixing member. Restated, the hardness of such a microscopic region of an object is difficult to be expressed in International Rubber Hardness Degrees (IRHD), which expresses a macroscopic hardness value of an object. Therefore, the hardness of a microscopic region is expressed in the universal hardness (HU), which expresses a microscopic hardness value of an object. According to the universal hardness measurement method, the hardness of an object can be evaluated, if a surface layer of the object has a thickness of at least 1 μm. Therefore, with the universal hardness measurement method, the hardness of an object can be measured by pushing a hardness tester into the surface of the object down to a depth from about 10 μm to about 20 μm, for example. Compared with this method, it is difficult to measure the hardness of an object with this push-in depth of about 10 μm to about 20 μm using a conventional microrubber hardness tester or the like.

A more detailed description is then made on the universal hardness, which was used in the present embodiment as an indicator of the surface hardness of fixing belts.

The universal hardness (HU) value, which is expressed in a unit of $N/mm^2$, is obtained by dividing applied load by area of a cross section in which a measurement terminal is pushed. The universal hardness is a standard in compliance with ISO 14577 standard set by International Organization for Standardization (ISO), which substantially corresponds to German Standard DIN 50359. Compared with a conventional standard used for hardness measurement, in the universal hardness measurement method, changes caused by varying the load to be applied to a super-microscopic region are consecutively recorded, so that a characteristic value of a surface film of an object can be expressed more in detail.

In the experiment cited in the above description of the present embodiment, the Vickers Hardness Tester was used as a measurement terminal. Although Japanese Laid-Open patent publications Nos. 2003-76167 and 2003-98871 discuss the universal hardness, the publications do not describes any correlation between the pressure and the universal hardness.

In the example, the universal hardness was measured with a push-in depth of 10 μm, in consideration of the vertical difference between the bottom of a concave portion and the top of a convex portion. Further, the universal hardness of some materials is highly dependent on temperature. Therefore, the universal hardness was measured at a fixing temperature actually used for executing image fixation. The graph of FIG. 6 indicates the obtained universal hardness values. As described above, it is determined that the universal hardness correlates to the deterioration in image quality such as the uneven glossiness.

In the example, the universal hardness was measured for seven types of fixing belts by varying the surface pressure applied to a nip portion. In the graph of FIG. 6, the horizontal axis indicates the universal hardness, while the vertical axis indicates the surface pressure. Points appearing in the graph represent results of the respective samples. Parenthesized numbers from 1 to 7 provided for the points represent belt numbers assigned respectively to the seven types of fixing belts. The shapes of the points, that is, diamond, triangle, square, and circle represent image quality ranks of the respective samples. Specifically, the diamond mark indicates Rank 3, the triangle mark Rank 3.5, the square mark Rank 4, and the circle mark Rank 4.5. A larger number indicates a higher rank and better image quality. Table 1 provided below indicates materials and thickness values of the elastic layer and the releasing layer forming each of the seven types of fixing belts.

TABLE 1

| Belt. No. | Elastic Layer | Releasing Layer |
|---|---|---|
| 1 | Silicone (JIS-A Hs10) 300 μm | PFA20 μm |
| 2 | Silicone (JIS-A Hs30) 300 μm | PFA20 μm |
| 3 | Silicone (JIS-A Hs30) 200 μm | PFA30 μm |
| 4 | Silicone (JIS-A Hs30) 300 μm | PFA30 μm |
| 5 | Silicone (JIS-A Hs27) 200 μm | PTFE + PFA10 μm |
| 6 | Silicone (JIS-A Hs27) 300 μm | PTFE + PFA10 μm |
| 7 | Silicone (JIS-A Hs27) 300 μm | PTFE + PFA20 μm |

The results shown in the graph of FIG. 6 were obtained from the examination conducted by using the above seven types of fixing belts under the following conditions. The fixing belt 2 is formed by combining a base material layer having a thickness of 90 μm with an elastic layer and a releasing layer of each type as indicated in Table 1.

The nip entrance fixing pad 4 is formed of a sponge sheet having a thickness of 5 mm. A width of a nip portion formed by the entrance fixing pad 4 is 4.5 mm, and a total pressure load applied at the nip portion is 39.2 N. The backup roller 7 has a diameter of 24 mm. A surface layer of the backup roller 7 is formed of sponge having an Asker C hardness of 53. The core metal of the backup roller 7 is formed of iron.

The press roller 3 has a diameter of 40 Fe mm. A surface layer of the press roller 3 is formed by a rubber sheet having a thickness of 0.5 mm and a PFA sheet having a thickness of 30 μm and an Asker C hardness of 94. The core metal of the press roller 3 is formed of iron.

Total pressure load applied at the exit portion of the nip area is in a range of from about 39.2 N to about 196 N.

The paper used is paper sold under the trademark RICOH TYPE6000 70W.

Temperature is set at 160 degrees centigrade as a standard condition. It has been confirmed, however, that a temperature within a range of from about 150 degrees centigrade to about 170 degrees centigrade, for example, does not affect the universal hardness and the evaluation of the image quality.

Nipping time is set to 40 ms as a standard condition. This nipping time is used at the nip portion B, which is used as a standard nip portion in the present experiment.

It has been confirmed, however, that a nipping time within a range of from about 40 ms to about 100 ms, for example, does not affect the evaluation of the image quality.

Surface roughness of the fixing belt surface is set in a range of Ra 0.1 μm to 1.0 μm, for example.

The universal hardness value is constant for each of the fixing belts 1 to 7.

The lower limit of maximum surface pressure (described later) generally used for executing toner fixation is set to 0.05 $N/mm^2$. The upper limit of the maximum surface pressure is set to 0.14 $N/mm^2$ based on an assumption that smaller surface pressure should be used in the present fixing device than in a conventional fixing device.

The maximum surface pressure refers to the largest surface pressure among average surface pressures obtained at different nip portions forming one nip area, when the nip area is formed by a plurality of members and the surface pressures at the different nip portions vary. The average surface pressure at a nip portion is obtained by dividing total pressure load (N) applied to the nip portion by area ($mm^2$) of the nip portion to which the pressure load is applied.

The fixing device 109 shown in FIG. 3 is configured such that the surface pressure becomes the highest at the second nip portion B. Accordingly, the maximum surface pressure in the present embodiment is the average surface pressure of the second nip portion B.

It is now assumed that Ranks 4 and 4.5 are defined as acceptable image quality. Then, it was determined from the results of the experiment conducted under the above conditions that the acceptable image quality without the uneven glossiness was obtained for the samples represented by the points shown in the graph of FIG. 6 located above a straight line representing the maximum surface pressure $P=0.062 \cdot HU$. The graph of FIG. 6 further indicates that, when the universal hardness HU of the fixing belt is equal to or less than 2.2 $N/mm^2$, the concavities and convexities of the surface of the recording medium S does not affect toner fixation, even if surface pressure applied at the exit portion of the nip area, i.e., the maximum surface pressure, is a relatively small value of less than 0.14 $N/mm^2$. To produce a fixing belt having the above universal hardness value, the fixing belt should include a releasing layer formed of a PFA sheet having a thickness of equal to or less than 30 μm, for example, and the elastic layer formed of a silicone rubber sheet having a thickness of 30 μm, for example, provided that a silicone rubber having a hardness of JIS-A Hs30 is used as the elastic layer.

Generally, rigidity is higher in a material forming the releasing layer than in a material forming the elastic layer. Therefore, the releasing layer should be as thin as possible without degrading durability thereof. Conversely, elasticity of the silicone rubber forming the elastic layer increases as the thickness of the silicone rubber increases. However, it is preferable to set the upper limit of the thickness of the elastic layer to about 300 μm, for example, in consideration of the amount of heat required for heating the fixing belt and the heat response of the fixing belt to the surface of the toner image. It is expected from the examination that the hardness of the elastic layer needs to be set to JIS-A Hs30 or less to reduce the thickness of the elastic layer down to 300 μm or less, for example, provided that a silicone rubber is used for forming the elastic layer.

Figure 7:
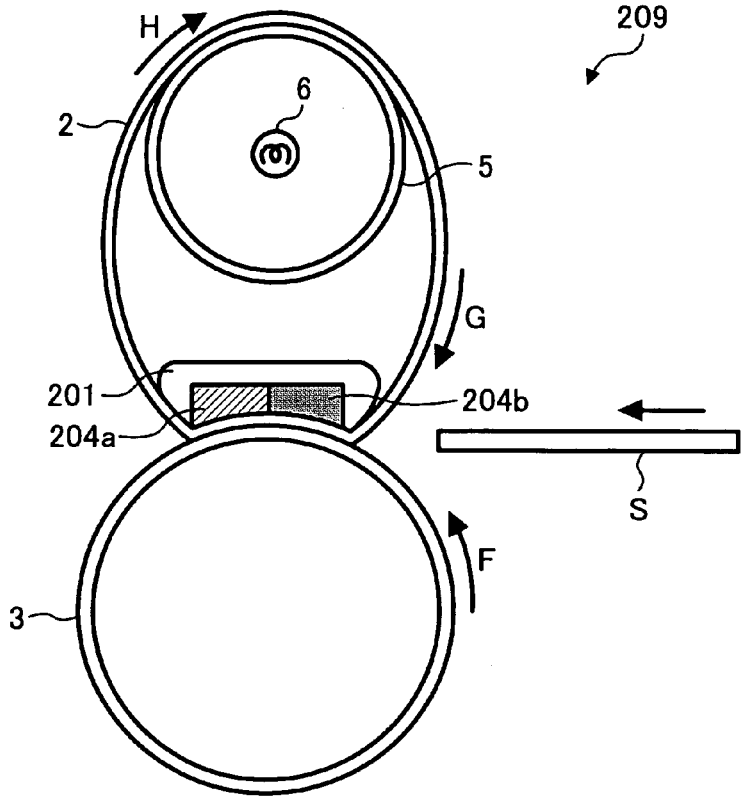
FIG. 7 is a schematic view of a fixing device according to another embodiment of the present invention.

Referring to FIG. 7, another embodiment of the present invention is described. This fixing device 209 of FIG. 7 is similar to the fixing device of FIG. 3 except for a press member 201, an exit-side elastic press member 204*a*, and an entrance-side elastic press member 204*b* provided in place of the press member 1 and the backup roller 7 of the fixing device 109. In the fixing device 209, the press member 201 is provided on the inside surface of the fixing belt 2 such that the exit-side elastic press member 204*a* and the entrance-side elastic press member 204*b* forming a surface of the press member 201 contact the inside surface of the fixing belt 2. The press roller 3 provided to face the press member 201 is pressed against the press member 201 via the fixing belt 2 with fixed pressure applied by a pressing unit (not shown). Restated, the elastic press members 204*a* and 204*b* forming the press member 201 are pressed to contact the press roller 3 via the fixing belt 2, so that a fixing nip area is formed. The pressing unit (not shown) such as a spring applies fixed pressure to the press member 201 such that higher surface pressure is applied at an exit portion than at an entrance portion of the fixing nip area. For example, different springs may be provided to press the exit-side elastic press member 204*a* and the entrance-side elastic press member 204*b*, respectively, from back sides thereof so that the higher surface pressure is applied at the exit portion than at the entrance portion of the fixing nip area. The surface pressure may be also increased at a side of the exit-side elastic press member 204*a* by forming the entrance-side elastic press member 204*b* with a sponge rubber and forming the exit-side elastic press member 204*a* with a hard rubber.

When the press roller 3 is driven to rotate in a direction indicated by arrow F shown in FIG. 7, the fixing belt 2 is rotated in a direction indicated by arrows G and H. When the fixing belt 2 rotates, the inside surface of the fixing belt 2 is pressed against the elastic press members 204*a* and 204*b* and the press member 201 including the elastic press members 204*a* and 204*b*. The fixing belt 2 passes over the heating roller 5 heated by the heat source 6, so that the surface of the fixing belt 2 contacting the heating roller 5 is heated. To reduce the start-up time of the fixing belt 2, the thickness of each of the press roller 3 and the heating roller 5 is set to be equal to or less than 1 mm.

The fixing device 209 of FIG. 7 is configured such that the higher surface pressure is applied at the side of the exit-side elastic press member 4*a* than at a side of the entrance-side elastic press member 4*b*. Accordingly, the maximum surface pressure in this example is the average surface pressure of the nip portion formed by the exit-side elastic press member 4*a* and the press roller 3.

As described above, according to the embodiment of the present invention, the surface of the fixing belt 2 can change shape to fit the microscopic concavities and convexities of the surface of the recording medium S, and also the amount of heat required for heating the fixing belt 2 can be reduced. As a result, high-quality image fixation and reduction in the start-up time and the energy consumption can be achieved.

Restated, even when the surface pressure is reduced to reduce the start-up time and the energy consumption, the embodiment can prevent the deterioration in image quality such as the uneven glossiness attributed to the microscopic concavities and convexities of the surface of the recording medium S.

Further, the belt structure of the fixing belt 2 allows changes in position and material of the backup roller 7 and the press member 1. Accordingly, a peak position of the nip area at which the surface pressure becomes the highest can be appropriately determined. Furthermore, if the peak position of the nip area formed by the fixing belt 2 and the press roller 3 is set in the nip portion B shown in FIG. 3, the toner sufficiently fused by the heat applied thereto at the nip portions A and C is fixed on the surface of the recording medium S at the nip portion B with the maximum surface pressure. Accordingly, the high-quality image fixation can be performed.

Further, the releasing layer 2*a* included in the fixing belt 2 prevents the toner disposed on the recording medium S from adhering to the surface of the fixing belt 2. Also, the elastic layer 2*b* included in the fixing belt 2 allows the surface of the fixing belt 2 to change form thereof to fit the surface of the recording medium S.

Accordingly, the high-quality image fixation can be performed. Further, the silicone rubber forming the elastic layer 2*b* provides both the flexibility desirable for the surface layer of a fixing member and the heat resistance against a set fixing temperature generally used, which ranges up to about 200 degrees centigrade. Furthermore, reduction in thickness of the elastic layer 2*b* down to 300 μm or less results in reduction in the amount of heat required for heating the fixing belt 2. As a result, the start-up time and the energy to be required can be reduced. Also, at least one of PTFE, PFA, and FEP included in the releasing layer 2*a* provides the surface layer of the fixing belt 2 with both the flexibility and the releasability from toner, which are characteristics used for the surface layer of the fixing member subjected to oil-less fixing processing. Moreover, the thickness of the releasing layer 2*b* set to 30 μm allows the surface of the fixing belt 2 to fit the microscopic concavities and convexities of the surface of the recording medium S. Accordingly, the deterioration in image quality such as the uneven glossiness can be prevented.

Moreover, the toner used in the present embodiment includes at least a binder resin, a coloring agent, and a wax. Therefore, the wax included in the toner allows the toner to be easily released from the surface of the fixing belt 2 at the exit of the nip area even in the oil-less fixing processing.

Figure 8:
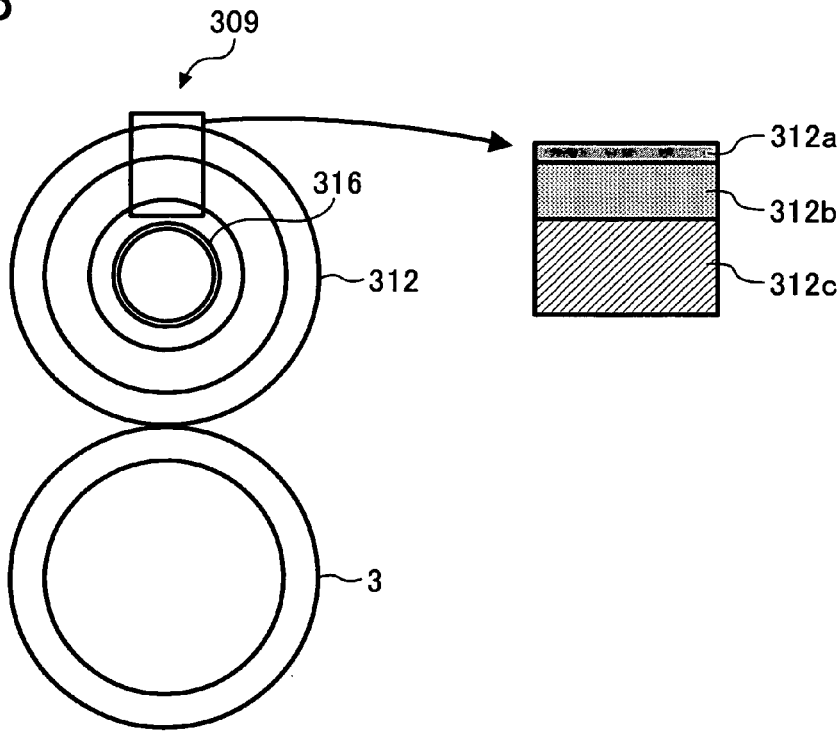
FIG. 8 is a schematic view of a fixing device according to another embodiment of the present invention.

Referring to FIG. 8, another embodiment of the present invention is described. This fixing device 309 of FIG. 8 is different from the fixing device 109 of FIG. 3 and the fixing device 209 of FIG. 7 in that a fixing roller 312 is used in place of the fixing belt 2 of the fixing devices 109 and 209.

The fixing roller 312 includes a releasing layer 312*a*, an elastic layer 312*b*, and a core metal 312*c*. The core metal 312*c* includes a heat source 316 such as a halogen heater. The heat source 16 may be replaced by an electromagnetic induction system.

A surface of the fixing roller 312 has the same characteristic value as the characteristic value of the surface of the fixing belt 2 used in the two embodiments. Further, the maximum surface pressure is set at the same value as the maximum surface pressure value set in the previous embodiments. Accordingly, prevention of the deterioration in image quality such as the uneven glossiness and reduction of the start-up time and the energy consumption can be similarly achieved by the present embodiment.

Furthermore, due to the roller structure of the fixing roller 312 used in place of the belt structure, the fixing roller 312 does not require a component member to prevent the fixing belt from bending. As a result, the fixing roller 12 can be formed by fewer components than the fixing belt 2.

In the present embodiment of FIG. 8, unlike the previous embodiments, a plurality of members do not form one nip area in which a different surface pressure is set for each of nip portions forming the nip area. Rather, the fixing roller 312 and the press roller 3 form a common nip area. Accordingly, the maximum surface pressure in this case equals the average surface pressure of the nip area formed by the fixing roller 312 and the press roller 3.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus, comprising:

an image forming mechanism configured to form an image; and a fixing unit configured to fix a toner image formed on a recording medium, the fixing unit including:

a first rotating member; and a second rotating member configured to form a nip together with the first rotating member, the second rotating member including a surface layer having a universal hardness HU and a maximum surface pressure P each within a predetermined range, wherein the universal hardness HU of the surface layer of the second rotating member, as measured with a push-in depth of 10 μm, satisfies the following equation:

$$0.5\ \mathrm{N/mm^2}) \leqq HU \leqq 2.2(\mathrm{N/mm^2}),$$

and the maximum surface pressure P satisfies the following equation:

$$0.062 \cdot HU(\mathrm{N/mm^2}) \leqq P \leqq 0.16(\mathrm{N/mm^2}).$$

2. The image forming apparatus as described in claim 1, wherein the second rotating member comprises:

a belt contacting the first rotating member; and at least one support member contacting the belt.

3. The image forming apparatus as described in claim 1, wherein the second rotating member comprises a roller configured to rotate about a rotation axis.

4. The image forming apparatus as described in claim 2, wherein the first and second rotating members are configured to form the nip comprising:

a nip entrance disposed on an upstream-side end of the nip in a conveyance direction of the recording medium;

a nip exit disposed on a downstream-side end of the nip area in the conveyance direction of the recording medium; and a nip portion having the maximum nip surface pressure and disposed closer to the nip exit than to a nip center.

5. The image forming apparatus as described in claim 1, wherein the second rotating member comprises:

an elastic layer comprising an elastic material; and a releasing layer having releasability from toner, covering the elastic layer, and providing the surface layer of the second rotating member configured to contact the toner image.

6. The image forming apparatus as described in claim 5, wherein the elastic layer comprises an elastic material having a heat resistance of at least about 200 degrees centigrade.

7. The image forming apparatus as described in claim 5, wherein the elastic layer has a maximum thickness of about 300 μm.

8. The image forming apparatus as described in claim 5, wherein the releasing layer comprises at least one of polytetrafluoroethylene resin (PTFE), polytetrafluoroethylene-perfluoroalkyl vinyl ether copolymer (PFA), and polytetrafluoroethylene-hexafluopropylene copolymer resin (FEP).

9. The image forming apparatus as described in claim 5, wherein the releasing layer has a maximum thickness of about 30 μm.

10. The image forming apparatus as described in claim 1, wherein the fixing unit is configured to fix toner comprising at least a binder resin, a coloring agent, and a wax.

11. An image forming apparatus, comprising:

image forming means for forming an image; and fixing means for fixing a toner image formed on a recording medium comprising:

first rotating means; and second rotating means for forming a nip together with the first rotating means, the second rotating means including a surface layer having a universal hardness HU and a maximum surface pressure P each within a predetermined range, wherein the universal hardness HU of the surface layer of the second rotating means, as measured with a push-in depth of 10 μm, satisfies the following equation:

$$0.5\ \mathrm{N/mm^2}) \leqq HU \leqq 2.2(\mathrm{N/mm^2}),$$

and the maximum surface pressure P satisfies the following equation:

$$0.062 \cdot HU(\mathrm{N/mm^2}) \leqq P \leqq 0.16(\mathrm{N/mm^2}).$$

12. The image forming apparatus as described in claim 11, wherein the second rotating means comprises:

a belt contacting the first rotating means; and at least one support member contacting the belt.

13. The image forming apparatus as described in claim 11, wherein the second rotating means comprises a roller configured to rotate about a rotation axis.

14. The image forming apparatus as described in claim 12, wherein the first and second rotating means are configured to form the nip comprising:

a nip entrance disposed on an upstream-side end of the nip in a conveyance direction of the recording medium;

a nip exit disposed on downstream-side end of the nip area in the conveyance direction of the recording medium; and a nip portion having the maximum nip surface pressure and disposed closer to the nip exit than to a nip center.

15. The image forming apparatus as described in claim 11, wherein the second rotating means comprises:

an elastic layer comprising an elastic material; and a releasing layer having releasability from toner, covering the elastic layer, and providing the surface layer of the second rotating means configured to contact the toner image.

16. The image forming apparatus as described in claim 15, wherein the elastic layer comprises an elastic material having a heat resistance of at least about 200 degrees centigrade.

17. The image forming apparatus as described in claim 15, wherein the elastic layer has a maximum thickness of about 300 μm.

18. The image forming apparatus as described in claim 15, wherein the releasing layer comprises at least one of polytetrafluoroethylene resin (PTFE), polytetrafluoroethylene-perfluoroalkyl vinyl ether copolymer (PFA), and polytetrafluoroethylene-hexafluopropylene copolymer resin (FEP).

19. The image forming apparatus as described in claim 15, wherein the releasing layer has a maximum thickness of about 30 μm.

20. The image forming apparatus as described in claim 11, wherein the fixing means is configured to fix toner comprising at least a binder resin, a coloring agent, and a wax.

21. A method for image forming for effectively fixing an image, comprising:

providing a first rotating member;

providing a second rotating member configured to form a nip together with the first rotating member;

rotating the first and second rotating members;

forming a toner image on a recording medium;

conveying the recording medium to the nip; and wherein the second rotating member includes a surface layer having a universal hardness HU and a maximum surface pressure P each within a predetermined range, and the universal hardness HU of the surface layer of the second rotating member, as measured with a push-in depth of 10 μm, satisfies the following equation:

$$0.5\ (\mathrm{N/mm^2}) \leqq HU \leqq 2.2(\mathrm{N/mm^2}),$$

and the maximum surface pressure P satisfies the following equation:

$$0.062 \cdot HU(\mathrm{N/mm^2}) \leqq P \leqq 0.16(\mathrm{N/mm^2}).$$

22. The method as described in claim 21, wherein the second rotating member comprises:

a belt contacting the first rotating member; and at least one support member contacting the belt.

23. The method as described in claim 21, wherein the second rotating member comprises a roller configured to rotate about a rotation axis.

24. The method as described in claim 22, wherein the first and second rotating members form the nip comprising:

a nip entrance disposed on an upstream-side end of the nip in a conveyance direction of the recording medium;

a nip exit disposed on a downstream-side end of the nip in the conveyance direction of the recording medium; and a nip portion having the maximum nip surface pressure and disposed closer to the nip exit than to a nip center.

25. The method as described in claim 21, wherein the second rotating member comprises:

an elastic layer comprising an elastic material; and a releasing layer having releasability from toner, covering the elastic layer, and providing the surface layer of the second rotating member configured to contact the toner image.

26. The method as described in claim 25, wherein the elastic layer comprises an elastic material having a heat resistance of at least about 200 degrees centigrade.

27. The method as described in claim 25, wherein the elastic layer has a maximum thickness of about 300 μm.

28. The method as described in claim 25, wherein the releasing layer comprises at least one of polytetrafluoroethylene resin (PTFE), polytetrafluoroethylene-perfluoroalkyl vinyl ether copolymer (PFA), and polytetrafluoroethylene-hexafluopropylene copolymer resin (FEP).

29. The method as described in claim 25, wherein the releasing layer has a maximum thickness of about 30 μm.

30. The method as described in claim 21, wherein the toner image is formed by toner containing at least a binder resin, a coloring agent, and a wax.

31. A fixing device, comprising:

a first rotating member; and a second rotating member configured to form a nip together with the first rotating member, the second rotating member including a surface layer having a universal hardness HU and a maximum surface pressure P each within a predetermined range, wherein the universal hardness HU of the surface layer of the second rotating member, as measured with a push-in depth of 10 μm, satisfies the following equation:

$$0.5\ (\mathrm{N/mm^2}) \leqq HU \leqq 2.2(\mathrm{N/mm^2}),$$

and the maximum surface pressure P satisfies the following equation:

$$0.062 \cdot HU(\mathrm{N/mm^2}) \leqq P \leqq 0.16(\mathrm{N/mm^2}).$$

32. The fixing device as described in claim 31, wherein the second rotating member comprises:

a belt contacting the first rotating member; and at least one support contacting the belt.

33. The fixing device as described in claim 31, wherein the second rotating member comprises a roller configured to rotate about a rotation axis.

34. The fixing device as described in claim 32, wherein the first and second rotating members are configured to form the nip comprising:

a nip entrance disposed on an upstream-side end of the nip in a conveyance direction of the recording medium;

a nip exit disposed on a downstream-side end of the nip in the conveyance direction of the recording medium; and a nip portion having the maximum nip surface pressure and disposed closer to the nip exit than to a nip center.

35. The fixing device as described in claim 31, wherein the second rotating member comprises:

an elastic layer comprising of an elastic material; and a releasing layer having releasability from toner, covering the elastic layer, and providing the surface layer of the second rotating member configured to contact the toner image.

36. The fixing device as described in claim 35, wherein the elastic layer comprises an elastic material having a heat resistance of at least about 200 degrees centigrade.

37. The fixing device as described in claim 35, wherein the elastic layer has a maximum thickness of about 300 μm.

38. The fixing device as described in claim 35, wherein the releasing layer comprises at least one of polytetrafluoroethylene resin (PTFE), polytetrafluoroethylene-perfluoroalkyl vinyl ether copolymer (PFA), and polytetrafluoroethylene-hexafluopropylene copolymer resin (FEP).

39. The fixing device as described in claim 35, wherein the releasing layer has a maximum thickness of about 30 μm.

40. The fixing device as described in claim 31, wherein the fixing device is configured to fix toner comprising at least a binder resin, a coloring agent, and a wax.

41. A fixing device, comprising:

fixing means for fixing a toner image formed on a recording medium, comprising:

first rotating means; and second rotating means to form a nip together with the first rotating means, the second rotating means including a surface layer having a universal hardness HU and a maximum surface pressure P each within a predetermined range, wherein the universal hardness HU of the surface layer of the second rotating means, as measured with a push in depth of 10 μm, satisfies the following equation:

$0.5\ (N/mm^2) \leqq HU \leqq 2.2 (N/mm^2)$, and the maximum surface pressure P satisfies the following equation:

$0.062 \cdot HU\ (N/mm^2) \leqq P \leqq 0.16 (N/mm^2)$.

42. The fixing device as described in claim 41, wherein the second rotating means comprises:

a belt contacting the first rotating means; and at least one support member contacting the belt.

43. The fixing device as described in claim 41, wherein the second rotating means comprises a roller configured to rotate about a rotation axis.

44. The fixing device as described in claim 42, wherein the first and second rotating means are configured to form the nip comprising:

a nip entrance disposed on an upstream-side end of the nip in a conveyance direction of the recording medium;

a nip exit disposed on a downstream-side end of the nip in the conveyance direction of the recording medium; and a nip portion having the maximum nip surface pressure and disposed closer to the nip exit than to a nip center.

45. The fixing device as described in claim 41, wherein the second rotating means comprises:

an elastic layer comprising an elastic material; and a releasing layer having releasability from toner, covering the elastic layer, and providing the surface layer of the second rotating means configured to contact the toner image.

46. The fixing device as described in claim 45, wherein the elastic layer comprises an elastic material having a heat resistance of at least about 200 degrees centigrade.

47. The fixing device as described in claim 45, wherein the elastic layer has a maximum thickness of about 300 μm.

48. The fixing device as described in claim 45, wherein the releasing layer comprises at least one of polytetrafluoroethylene resin (PTFE), polytetrafluoroethylene-perfluoroalkyl vinyl ether copolymer (PFA), and polytetrafluoroethylene-hexafluopropylene copolymer resin (FEP).

49. The fixing device as described in claim 45, wherein the releasing layer has a maximum thickness of at least about 30 μm.

50. The fixing device as described in claim 41, wherein the fixing means is configured to fix toner comprising at least a binder resin, a coloring agent, and a wax.

51. A method for effectively fixing an image, comprising:

providing a first rotating member;

providing a second rotating member configured to form a nip together with the first rotating member;

rotating the first and second endless moving members;

forming a toner image on a recording medium; and conveying the recording medium to the nip, wherein the second rotating member includes a surface layer having a universal hardness HU and a maximum surface pressure P each within a predetermined range, and wherein the universal hardness HU of the surface layer of the second rotating member, as measured with a push-in depth of 10 μm, satisfies the following equation:

$0.5\ (N/mm^2) \leqq HU \leqq 2.2 (N/mm^2)$, and the maximum surface pressure P satisfies the following equation:

$0.062 \cdot HU (N/mm^2) \leqq P \leqq 0.16\ (N/mm^2)$.

52. The method as described in claim 51, wherein the second rotating member comprises:

a belt contacting the first rotating member; and at least one support member contacting the belt.

53. The method as described in claim 51, wherein the second rotating member comprises a roller configured to rotate about a rotation axis.

54. The method as described in claim 52, wherein the first and second rotating member are configured to form the nip comprising:

a nip entrance disposed on an upstream-side end of the nip in a conveyance direction of the recording medium;

a nip exit disposed on a downstream-side end of the nip in the conveyance direction of the recording medium; and a nip portion having the maximum nip surface pressure and disposed closer to the nip exit than to a nip center.

55. The method as described in claim 51, wherein the second rotating member comprises:

an elastic layer comprising an elastic material; and a releasing layer having releasability from toner, covering the elastic layer, and providing the surface layer of the second rotating member configured to contact the toner image.

56. The method as described in claim 55, wherein the elastic layer comprises an elastic material having a heat resistance of at least about 200 degrees centigrade.

57. The method as described in claim 55, wherein the elastic layer has a maximum thickness of about 300 μm.

58. The method as described in claim 55, wherein the releasing layer comprises at least one of polytetrafluoroethylene resin (PTFE), polytetrafluoroethylene-perfluoroalkyl vinyl ether copolymer (PFA), and polytetrafluoroethylene-hexafluopropylene copolymer resin (FEP).

59. The method as described in claim 55, wherein the releasing layer has a maximum thickness of about 30 μm.

60. The method as described in claim 51, wherein the toner image is formed by toner containing at least a binder resin, a coloring agent, and a wax.

* * * * *